US007360609B1

(12) United States Patent
Falgout, Sr.

(10) Patent No.: US 7,360,609 B1
(45) Date of Patent: Apr. 22, 2008

(54) DIRECTIONAL DRILLING APPARATUS

(76) Inventor: Thomas E. Falgout, Sr., 110 Charles Read Ave., Lafayette, LA (US) 70503

( * ) Notice: Subject to any disclaimer, the term of this patent is extended or adjusted under 35 U.S.C. 154(b) by 268 days.

(21) Appl. No.: 11/124,449

(22) Filed: May 5, 2005

(51) Int. Cl.
*E21B 7/04* (2006.01)
*E21B 4/02* (2006.01)

(52) U.S. Cl. ..... 175/61; 175/74; 175/107; 166/237

(58) Field of Classification Search ..... 175/61, 175/62, 73, 74, 107, 320; 166/237
See application file for complete search history.

(56) References Cited

U.S. PATENT DOCUMENTS 4,596,294 A * 6/1986 Russell ..... 175/74
5,232,058 A * 8/1993 Morin et al. ..... 175/73
5,316,093 A * 5/1994 Morin et al. ..... 175/74
5,495,900 A 3/1996 Falgout
6,241,032 B1 6/2001 Falgout
6,540,020 B1 4/2003 Falgout
6,799,646 B1 10/2004 Daigle et al.
6,955,231 B1 * 10/2005 Bakke ..... 175/61

* cited by examiner

*Primary Examiner*—Kenneth Thompson
(74) *Attorney, Agent, or Firm*—John D. Jeter

(57) ABSTRACT

A general housing encloses a drilling motor that can be disabled to permit optimum rotary drilling practice. A mode selector responds to manipulation of the drilling fluid flow rate and permits activation of the drilling motor to drive a drill bit. The general housing is a two part arrangement that is connected by a deflection arrangement that is activated by start-up of the motor. A one-way clutch allows the lower housing to drive the drill bit when the motor is disabled and the clutch, with drill bit rotation resistance, changes the deflection arrangement for straight rotary drilling when the drill string is rotated.

14 Claims, 5 Drawing Sheets

DIRECTIONAL DRILLING APPARATUS

This invention pertains to apparatus for use in the bottom hole assembly of a drill string to influence the direction of the bore of a well being drilled. Further, it pertains to apparatus that disables a drilling motor to permit rotary, straight hole drilling, and enables the motor and deflects the housing for directional drilling.

BACKGROUND

Directional drilling usually involves down-hole drill bit driving drilling motors. The motors are usually powered by the drilling mud flowing down the drill string bore. The motors are usually of the positive displacement type. Such motors are currently limited in terms of drilling fluid pressure drop through the motor. Motor output power is proportional to the pressure drop. The acceptable pressure drop is usually much less than the available pressure that the surface pumps could supply. Drilling motors seldom deliver the maximum available horsepower to the drill bit.

The pressure drop through the motor is proportional to motor output torque, and modern drill bits are often capable of using more torque than drilling motors can provide. In many such cases, the common rotary practice can drill hole more economically without the motor. The motor, however, may be essential to well bore direction control.

If directional control is necessary, a down hole assembly often has to have steerable rotary apparatus or a motor with a bore deflecting ability. Either choice adds a technical and economical burden to the drilling activity.

There is a need for rotary drilling assembly that can accommodate a down hole motor. The motor is needed periodically to provide a hole direction influence. The motor needs to be capable of efficient activation and de-activation so that optimum rotary practice can be applied most of the drilling time.

If the drilling motor is used a small percentage of the drilling time, it can be made somewhat smaller than greater dependence upon the motor would allow. By reducing the motor size, the wall thickness of the motor housing can be thickened to accept greater rotary torque. Overall benefit is realized from the ability to readily switch from one mode of drilling to another.

When the motor is activated, it is advantageous to deflect the drilling assembly, ideally with the same down link command. That can be accomplished if the motor drives the deflection apparatus. While the motor runs, then, the deflection is effective. While the motor is disabled, then, the rotary system drives the drill bit in the straight hole drilling mode.

While the motor is activated, the progressing well bore needs directional control. Such control, in terms of orientation, can be provided by Measurement While Drilling (MWD) apparatus. The MWD apparatus, currently available, does not control drill string deflecting apparatus. To get the best use of drill string deflecting apparatus, there is a need for some form of down link command that is reliable and simple to exercise. In addition to down link command, there is a need to have some form or reaction feedback that indicates, in real time, that the command is being carried out.

SUMMARY OF THE INVENTION

To accomplish down link command control, the apparatus responds to alternate onsets of drilling fluid flow. For instance, on even actuations, it may cause deflection and direct drilling fluid flow through the motor. On odd actuations, the apparatus may open drilling fluid by-pass channels, weakening the drilling motor torque. The drill string rotary drive acts through a one-way clutch to mechanically by-pass the motor and drive the drill bit from drill string delivered torque. The general apparatus housing is divided but the upper housing and the lower housing are connected by a tilted deflector bearing assembly. The rotation of the drill string is conducted through the upper housing to the deflector bearing, and drill bit rotation resistance causes the lower housing to rotate, a limited amount, counterclockwise to the straight configuration allowing straight drilling rotary practice independently of the motor.

When the motor by-pass channel is closed (the drill string rotation may be stopped) the motor acts through a resisting one-way clutch to rotate the lower housing clockwise to the deflected configuration. The lower housing carries the output shaft bearings and controls deflection of the drill bit from the center line of the upper housing. The deflected drill bit changes the direction of the evolving well bore. Because of the simplicity of the change in configuration, frequent small corrections become possible. Severe changes in well bore direction can be reduced.

The by-pass channel has minimized pressure loss, in contrast to the motor driving pressure drop. When changing to the rotary, straight hole, drilling mode the stand pipe pressure at a selected flow rate is reduced and the reduction is an indication that the straight rotary mode is in effect down hole. This is a feed-back signal that leaves no doubt about the mode in effect down hole. Changing from the rotary drilling mode has the opposite, detectable, effect.

These and other objects, advantages, and features of this invention will be apparent to those skilled in the art from a consideration of this specification, including the attached claims and appended drawings.

DETAILED DESCRIPTION OF DRAWINGS

The overall apparatus includes a mode selector, a motor connected to the final output shaft, a motor by-pass valve responsive to the mode selector, a general housing with an upper housing and a lower housing connected by a tilted bearing allowing limited rotation of the lower housing relative to the upper housing, and a one-way resisting clutch which allows the drill string to drive the drill bit clockwise but allows the motor, when activated, to first rotate the lower housing clockwise to the deflected configuration, then drive the drill bit clockwise for drilling while the drill string does not rotate.

Figure 1:
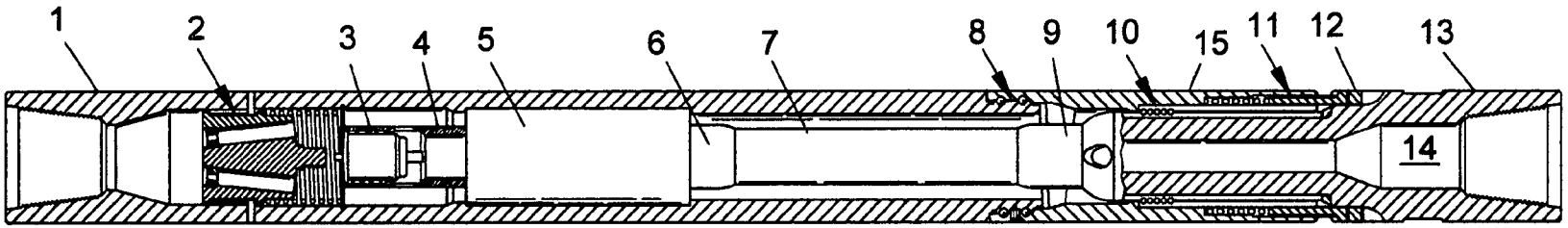
FIG. 1 is a side view, mostly cut away, showing a mode selector, a motor, a valve to activate the motor selectively and apparatus allowing the motor to execute the drill string deflecting mechanism.
Figure 2:
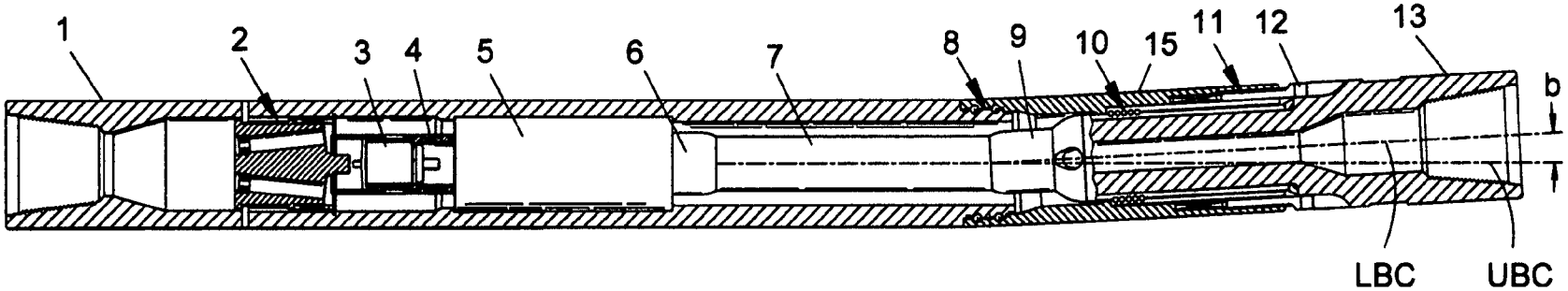
FIG. 2 is identical to FIG. 1 with the mode selector activated and the drill string deflected for a directional drilling interval.

FIGS. 1 and 2 show upper housing 1 connected to lower housing 15 by tilted bearing 8. Motor 5 is connected to output shaft 13 by shaft 7 by way of couplings 6 and 9. Mode selector 2 acts to control by-pass valve 3 which opens or closes channel 4. Channel 4 extends through the bore in the motor rotor. Bearing 10 has radial and thrust bearings to position the output shaft 13 within the lower housing 15. One-way clutch 11 is biased against interdigitating teeth 12 to resist, but allow, rotation of the output shaft relative to the lower housing 15. Fluid channel 4, and fluid passing through the motor passes through channel 14 to flush the drill bit (not shown). FIG. 2 shows the apparatus in the deflected configuration. Lower housing 15 has been rotated relative to the upper housing by the motor that is made operational by the actuation of mode selector 2, closing by pass valve 3 to cause most of the drilling fluid to pass through the motor. The deflection is shown as angle b relating the upper housing and the lower housing. Clutch 11 is spline connected to the lower housing and may be dis-engaged from the output shaft.

Figure 3:
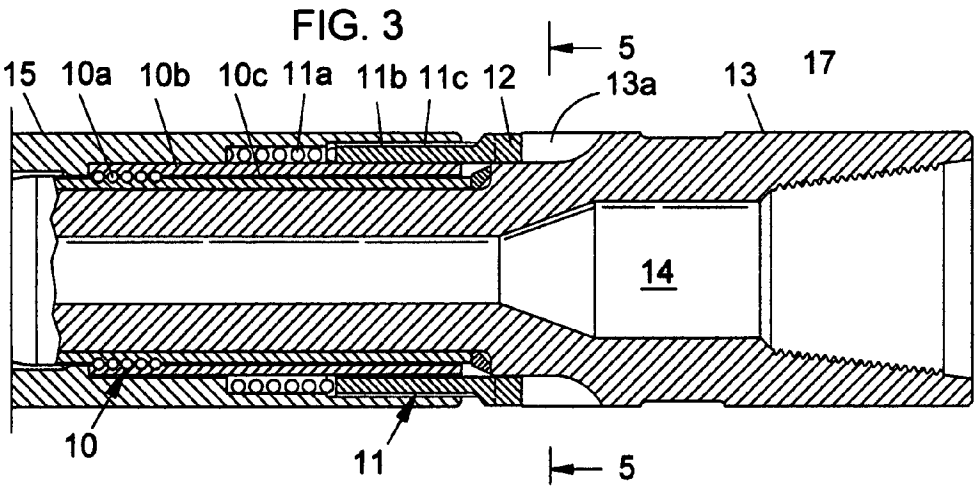
FIG. 3 is a side view, somewhat enlarged, of the lower end of the apparatus of FIG. 1.
Figure 4:
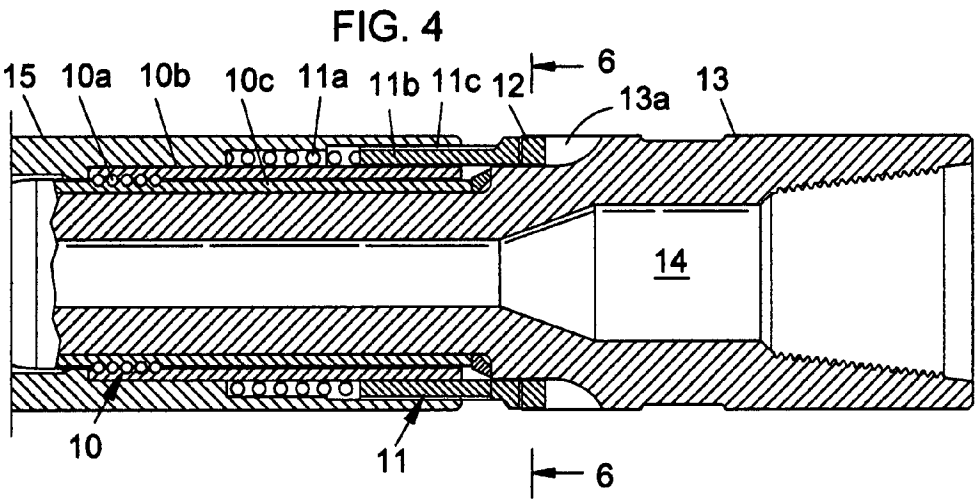
FIG. 4 is identical to FIG. 3, with the motor having activated the one-way clutch to urge the lower end of the motor housing into a deflection activity, the deflection still pending.

FIGS. 3 and 4 show clutch 11 connecting the lower housing 15 and output shaft 13. Output shaft 13 is supported in the lower housing by bearing assembly 10 which includes thrust bearing 10*a* and radial bearing sleeves 10*b* and 10*c*. Clutch 11 includes spring 11*a* which urges clutch element 11*b*, with splines 11*c* and clutch teeth 12 into engagement with clutch grooves 13*a* on the output shaft 13. The clutch is dis-engaged in FIG. 3 and is engaged in FIG. 4. Resistance of the clutch will rotate housing 15 clockwise to deflect the lower housing in response to rotation of the output shaft. It is not yet shown deflected. When the motor is not driving the output shaft, and the drill string rotates the upper housing, the clutch will engage and resistance of the drill bit (not shown) will cause the lower housing to rotate counterclockwise relative to the upper housing, to limits, and straighten the overall housing. In addition to drill bit rotation resistance, any stabilizers present on the lower housing will add rotation resistance to urge the lower housing to the straight configuration.

Figure 5:
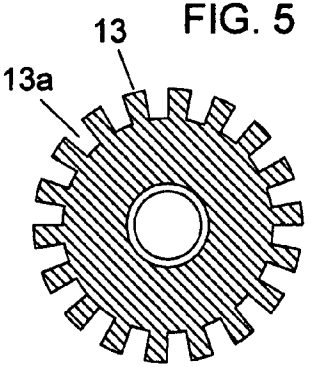
FIG. 5 is a section taken along line 5-5, showing primary clutch features.

FIG. 5 shows grooves 13*a* on output shaft 13.

Figure 6:
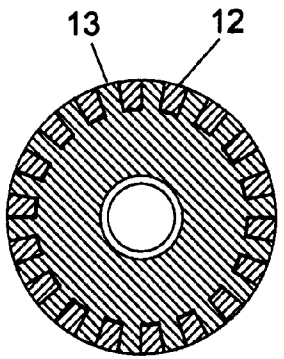
FIG. 6 is identical to FIG. 5, but with the clutch still engaged.

FIG. 6 shows clutch teeth 12 engaging teeth 13*a* of the output shaft 13.

Figure 7:
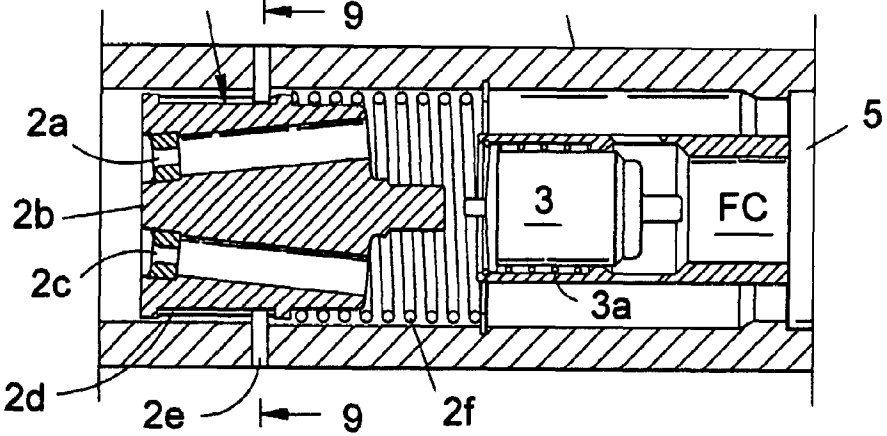
FIG. 7 is a side view of the mode selector and a by-pass valve not activated, and is the configuration for rotary drilling.

FIG. 7 shows mode selector 2 urged to a first position by spring 2*f*. By-pass valve 3 is urged open by spring 3*a* and drilling fluid flows through channel FC, weakening the motor output torque. Pins 2*e* engage serpentine grooves 2*d* and stop movement of the armature 2*b* short of the valve on alternate rightward excursions. The rightward excursions are induced by drilling fluid flow through resistance ports 2*a* and 2*c*.

Figure 8:
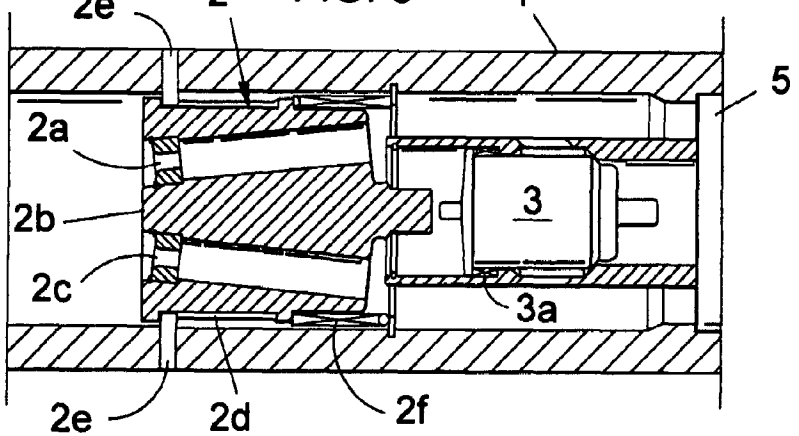
FIG. 8 is a side view, identical to FIG. 7, but with the mode selector having actuated the motor by-pass valve to drive the motor for deflected state drilling with the motor active.

FIG. 8 shows the mode selector moved rightward by an alternate onset of drilling fluid flow. When arbor 2*b* engages the valve 3, it is urged to closure. The valve 3 is driven closed by fluid pressure and moves some amount after the arbor 2*b* is stopped by travel limits, avoiding continuous engagement between stationary and rotating parts.

Figure 9:
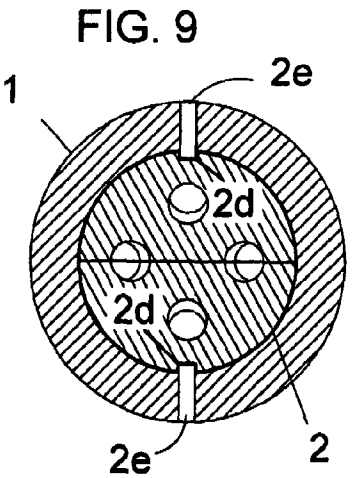
FIG. 9 is a section taken along line 9-9.

FIG. 9 shows the relationship between pins 2*e* and arbor 2*b*.

Figure 10:
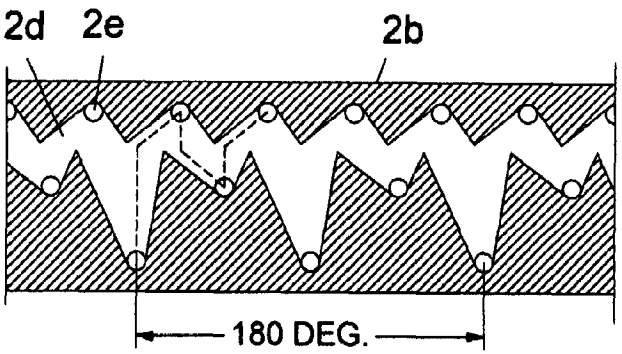
FIG. 10 is a development of the surface of the mode selector, a turnstile walk-around function selector.

FIG. 10 is a surface development of the serpentine grooves 2*d* which cause the arbor to rotate during excursions. This is the usual configuration of walk-around mode selectors now in common use in down hole tools.

Figure 11:
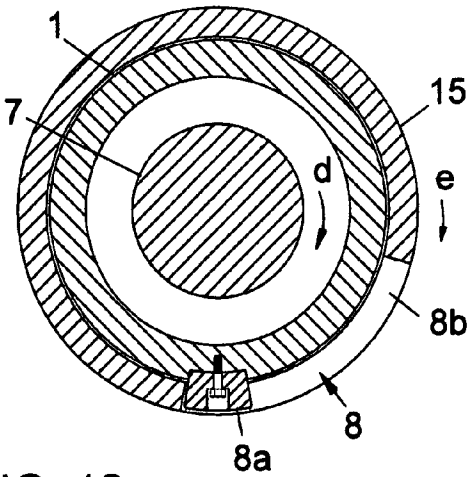
FIG. 11 is a section taken along line 11-11, showing a rotation control that provides deflection by motor rotation.
Figure 12:
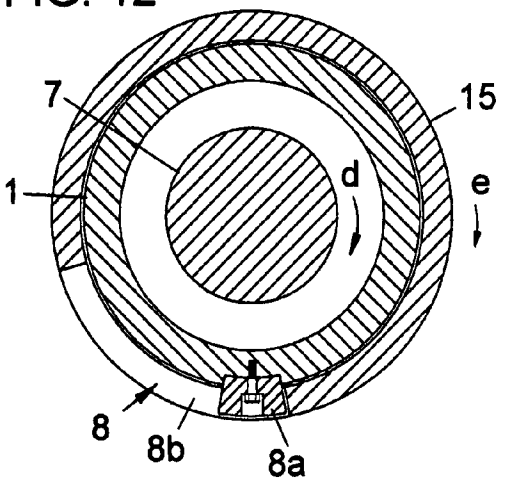
FIG. 12 is identical to FIG. 11, with the deflection rotation activated.
Figure 18:
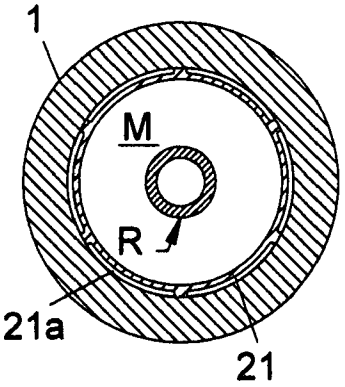
FIG. 18 is a section taken along line 18-18.
Figure 19:
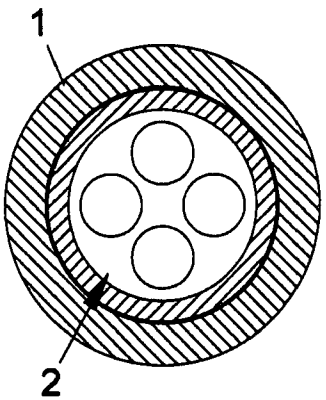
FIG. 19 is a section taken along line 19-19.

FIGS. 11 and 12 show the preferred form of rotation limiting elements between upper housing 1 and lower housing 15. The drive shaft 7 of the motor rotates as shown by arrow d and the clutch, see FIGS. 3 and 4, drives the lower housing 15 as shown by arrow e. Slot 8*b* permits lug 8*a* to move a limited amount. The tilted bearing of FIG. 13 causes that amount of rotation to deflect the lower housing 15 a pre-selected amount relative to upper housing 1.

Figure 13:
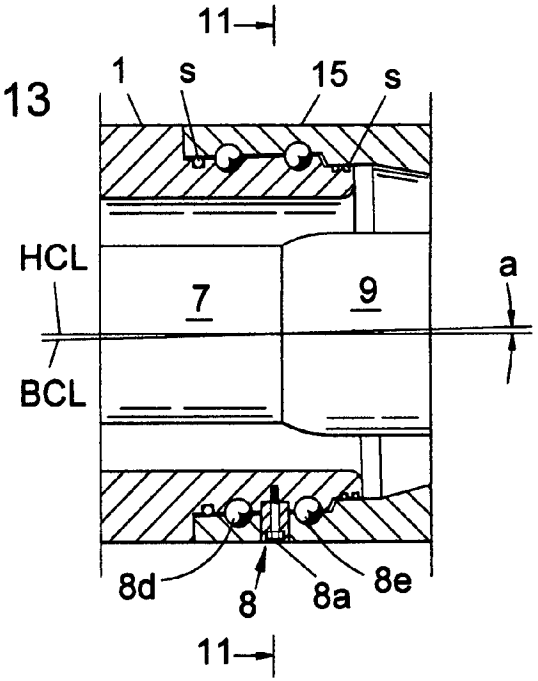
FIG. 13 is a fragmented portion of the apparatus of FIG. 1 showing tilted bearings that allow the motor to deflect the lower end of the apparatus housing.

FIG. 13 shows the tilted bearing assembly 8 connecting upper housing 1 and lower housing 15. Bearing balls 8*d* and 8*e* and related races are situated on an axis BCL which is tilted angle a relative to the upper housing centerline HCL. Rotation of the lower housing relative to the upper housing causes the pre-selected amount of deflection of the lower housing. Seals s permit access to the lug 8*a* from outside the general housing.

Figure 14:
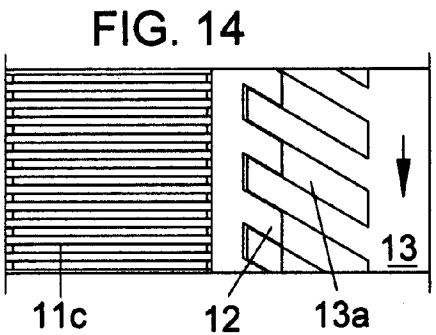
FIG. 14 is a surface development of the clutch arrangement that allows motor rotation to deflect the lower end of the apparatus housing.

FIG. 14 shows the mechanism of resistance to initial relative rotation of the output shaft 13 relative to the lower housing. The teeth are biased into engagement and are engaged at an angle. To dis-engage the clutch, torque has to be applied to separate the teeth. Once separated, the teeth do not re-engage readily because of fluid damping common to moving elements in a down hole situation.

Figure 15:
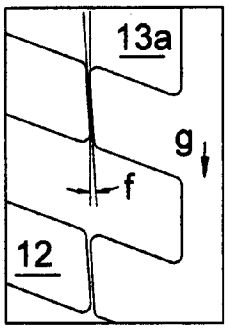
FIG. 15 is a surface development of a portion of the clutch teeth when the clutch is disengaged.

FIG. 15 shows the teeth 12 riding over the crests of the teeth between grooves 13*a*. Grooves 13*a* move in the direction of arrow g. The crests of the teeth are slightly angled at a pre-selected angle f and thrusts the teeth apart at a rate that is compatible with the fluid damped movement of the clutch toward engagement. While movement exists, the teeth do not engage. When the motor is disabled and the housing transmits drill string rotation to the output shaft, teeth 12 move in the direction of arrow g and the teeth freely engage. The drill string can then drive the drill bit. Teeth 12 cannot rotate relative to the lower housing. The torque that drives the drill bit rotates the lower housing to urge it to the straight configuration. Rotary drilling practices then continue without regard to the idle motor.

Figure 16:
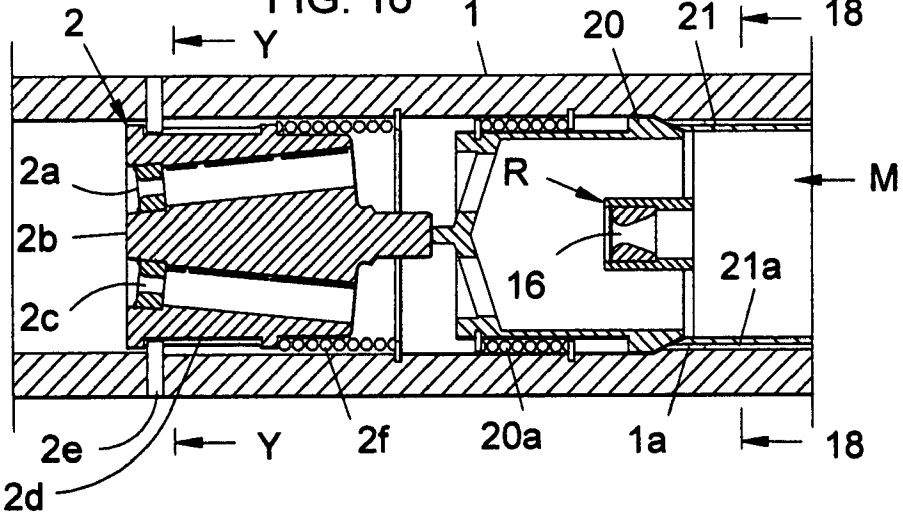
FIG. 16 is a side view of a selected portion of the apparatus showing the mode selector and an alternate form of the by-pass valve.
Figure 17:
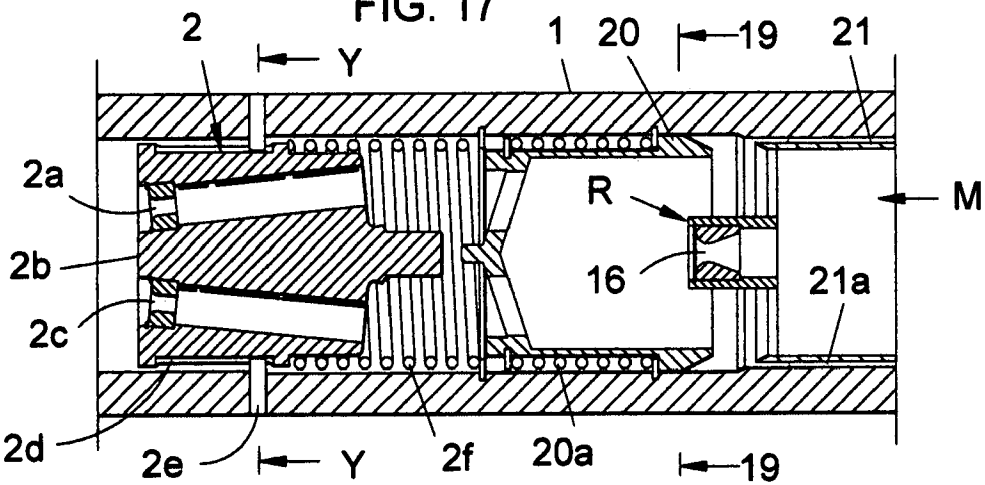
FIG. 17 is identical to FIG. 16, but before actuation of the by-pass valve.

FIGS. 16 and 17 show an alternate routing for by-pass of drilling fluids. Motor M has an outer jacket 21 that fits in the bore of the upper housing, with fluid channels 21*a* situated between the housing bore and the jacket. The rotor R has a bore with restrictor 16 at the entry end. Tubular valve element 20 moves downward, opposed by spring 20*a*, to occlude the peripheral by-pass openings. Mode selector 2 is unchanged.

With the peripheral by-pass channels, the rotor bore is not required. If the rotor bore is present, the valve plug 3 of FIG. 7 can be carried by the element 20 of FIG. 16 to control greater by-pass channel capacity.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. A drilling apparatus comprising:

a) a general apparatus housing, arranged to function as a serial element of a drill string, comprising an upper housing and a lower housing, the upper and lower housings connected by a tilted bearing permitting limited rotation between the upper and lower housings, the upper and lower housings having independent center lines, said upper housing having a tool joint connection for attachment to a drill string;

b) a drilling fluid powered motor, in the general housing, connected to an output shaft arranged to attach to, and to drive, a drill bit;

c) a drilling fluid by-pass channel, in said general housing, to by-pass said motor;

d) a mode selector in the upper housing responsive to manipulation of the drilling fluid flow rate to engage and actuate a drilling fluid by-pass valve;

e) said drilling fluid by-pass valve, in the general housing, responsive to said mode selector, to open or close said drilling fluid flow by-pass channel;

f) a one-way clutch, driven by the output shaft, that resists dis-engagement, arranged to allow the lower housing to drive the drill bit clockwise but allowing the drill bit to rotate clockwise relative to the lower housing, the resistance arranged to rotate the lower housing clockwise relative to the upper housing before dis-engagement; and g) said tilted bearing that allows the lower end of the housing to rotate a limited amount relative to the upper housing to deflect the lower housing centerline relative to the centerline of said upper housing.

2. The apparatus according to claim 1 wherein said limited amount of rotation of the tilted bearing is arranged such that the center lines of both upper and lower housings lie along one line at one extreme of said limited amount of rotation.

3. The apparatus according to claim 1 wherein said mode selector is a turnstile walk-around selector that is stopped short of actuating said by-pass valve during first instances of actuations and travels a greater distance during second instances of actuations to activate said by-pass valve, said engagements and actuations comprising selective distance of movement of a mechanical element of said mode selector.

4. The apparatus according to claim 1 wherein said tilted bearing has an axis of rotation that is not parallel to the centerline of either said upper housing or said lower housing.

5. The apparatus according to claim 1 wherein said motor is connected to said output shaft by a flexible drive shaft.

6. The apparatus according to claim 1 wherein said drilling fluid by-pass valve, when closed, causes most of said drilling fluid to pass through the motor to produce rotational power.

7. The apparatus according to claim 1 wherein said by-pass channel and said motor have different resistance to drilling fluid flow by which the difference in pressure indicated at the standpipe can function as a feed-back signal to indicate which mode is in effect down hole.

8. The apparatus according to claim 1 wherein said drilling fluid by-pass channel comprises a space between an outer jacket of said motor and said general apparatus housing.

9. The apparatus according to claim 1 wherein said drilling fluid by-pass channel comprises a bore through a rotor in said motor.

10. The apparatus according to claim 1 wherein said by-pass valve is biased toward an open position and is situated to be driven toward closure by the flow of drilling fluid after said mode selector moves it some selected distance toward closure.

11. The apparatus according to claim 10 wherein said by-pass valve is arranged to move away from said mode selector, after actuation, and to rotate in contact with said rotor while said by-pass channel is closed.

12. The apparatus according to claim 10 wherein said by-pass channel is arranged to direct fluid through the bore of a downwardly continuing drill string attached to said motor.

13. A drilling method, according to claim 1, comprising:

a) assembling a drill string, including a drill bit driving, mud powered, motor in the bottom hole assembly arranged to cooperate with a drill string deflecting apparatus in reaction to downlink commands and producing drilling fluid pressure influence, detectable at the standpipe, to indicate the mode of operation being exercised down hole, the modes of operation including a first mode of driving the bit with the motor and deflecting the drill string and a second mode of disabling the motor and driving the drill bit by rotary drill string torque in a straight drilling configuration;

b) initiating drilling fluid flow down the drill string and manipulating the drilling fluid flow rate to select, from stand pipe pressure indications, the preferred mode of operation down hole;

c) proceeding with drilling in the selected mode until a desired result is achieved;

d) exercising manipulation of the drilling fluid flow controls to produce a downlink command to change the mode of operation down hole, as indicated by standpipe pressure; and e) proceeding with drilling in the other mode until the desired result is achieved.

14. The method according to claim 13 wherein said drilling fluid flow rate manipulations includes increasing flow rate from a first flow rate to a second, higher, flow rate and decreasing the flow rate to said first flow rate.

* * * * *